US005311920A

United States Patent [19]

Cook

[11] Patent Number: 5,311,920

[45] Date of Patent: May 17, 1994

[54] METHOD OF FORMING A METAL MATRIX COMPONENT WITH INTERNAL AND EXTERNAL STRUCTURES

[76] Inventor: Arnold J. Cook, 372 N. Craig St., Pittsburgh, Pa. 15213

[21] Appl. No.: 27,932

[22] Filed: Mar. 8, 1993

Related U.S. Application Data

[63] Continuation of Ser. No. 737,493, Jul. 29, 1991, abandoned.

[51] Int. Cl.[5] ..... B22D 19/02; B22D 19/14

[52] U.S. Cl. ..... 164/97; 164/98; 164/132

[58] Field of Search ..... 164/132, 97, 98

[56] References Cited

U.S. PATENT DOCUMENTS 4,508,158 4/1985 Amateau et al. ..... 164/97

FOREIGN PATENT DOCUMENTS 51-14821 2/1976 Japan ..... 164/98

2-34248 2/1990 Japan ..... 164/132

*Primary Examiner*—Kuang Y. Lin

*Attorney, Agent, or Firm*—Ansel M. Schwartz

[57] ABSTRACT

The present invention pertains to a method of forming a metal matrix composite. The method comprises the steps of surrounding at least one insert with reinforcement material. Next, there is the step of orienting the insert and reinforcement within a mold. Then, there is the step of infiltrating the mold with liquid metal such that the reinforcement material around the insert is infiltrated. In a preferred embodiment, the insert comprises a hollow core and closed ends and the surrounding step includes the step of wrapping reinforcement around the insert. Preferably, the hollow core is exposed and the insert is leached out with the appropriate leaching solution.

31 Claims, 5 Drawing Sheets

METHOD OF FORMING A METAL MATRIX COMPONENT WITH INTERNAL AND EXTERNAL STRUCTURES

This is a continuation of copending application Ser. No. 07/737,493 filed on Jul. 29, 1991, now abandoned.

FIELD OF THE INVENTION

The present invention is related to casting. More specifically, the present invention is related to a method of forming internal structures within a metal matrix component.

BACKGROUND OF THE INVENTION

Composite products comprising reinforcing material surrounded by a matrix of metal combine the stiffness and wear resistance of the reinforcing phase with the ductility and toughness of the metal matrix. In order to produce metal matrix components, the appropriate reinforcement material is first oriented within a mold. Then, the desired liquid metal is forced into the mold so that it completely fills the interstices of the reinforcement material.

There are many instances when it would be desirable to form internal structures within the metal matrix component. An example of this is when the thermal characteristics of the metal matrix composite is of functional importance. By adding channels within a metal matrix component, circulating fluid can be used to cool or heat the component more efficiently than by external means. Alternatively, sealed voids within a metal matrix component can be used to selectively alter the insulative properties or weight of a metal matrix component.

In many cases, the complexity of these structures makes it impossible to produce a mold which can form the desired shape and void characteristics of the metal matrix component and still be released therefrom to remove the component from the mold. Further, the superior strength, abrasive properties of metal matrix materials makes it expensive, if not impossible, to form the voids after the component is solidified.

Internal structures within metal matrix composites can be used for cooling passages, welding surfaces, electrical feedthroughs, drill locations and for mirror surfaces.

SUMMARY OF THE INVENTION

The present invention pertains to a method of forming a metal matrix composite. The method comprises the steps of combining at least one insert with reinforcement material. Next, there is the step of orienting the insert and reinforcement within a mold. Then, there is the step of infiltrating the mold with liquid metal such that the reinforcement material around the insert is infiltrated. In one preferred embodiment, the insert comprises a hollow core with closed ends and the surrounding step includes the step of wrapping reinforcement around the insert. Preferably, after infiltration, the hollow core is exposed and the insert is leached out with the appropriate leaching solution.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1A:
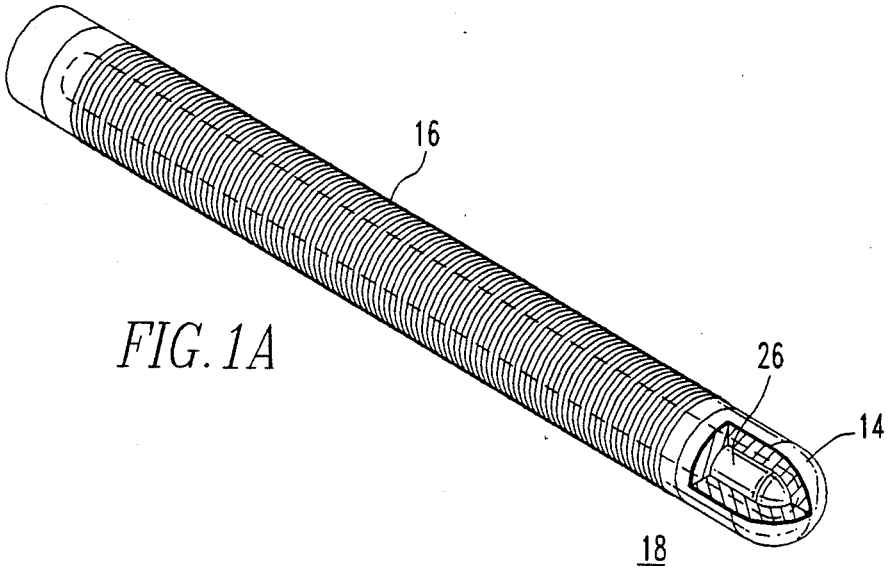
FIGS. 1A-1C are perspective views showing the casting of a metal matrix component having several inserts with closed ends and reinforcement wrapped about.
Figure 1B:
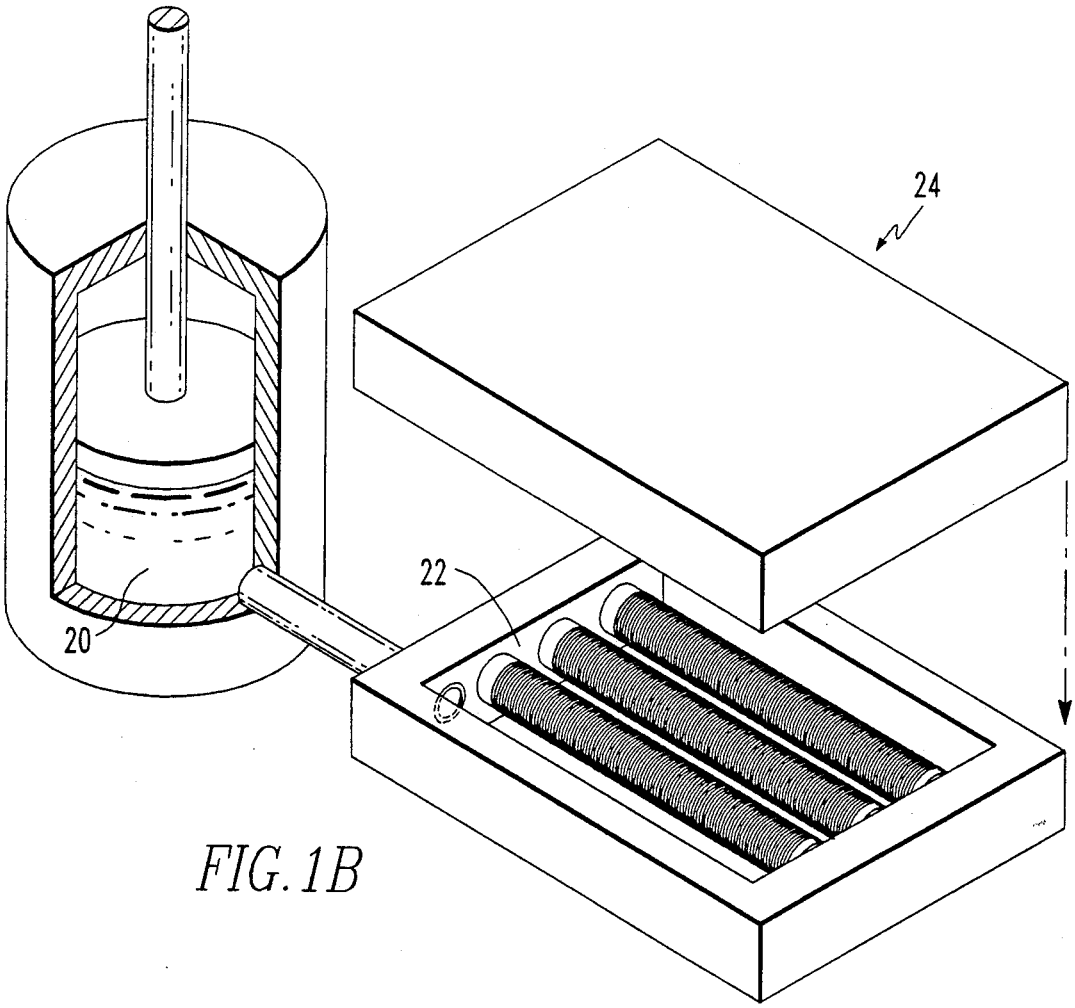
Figure 1C:
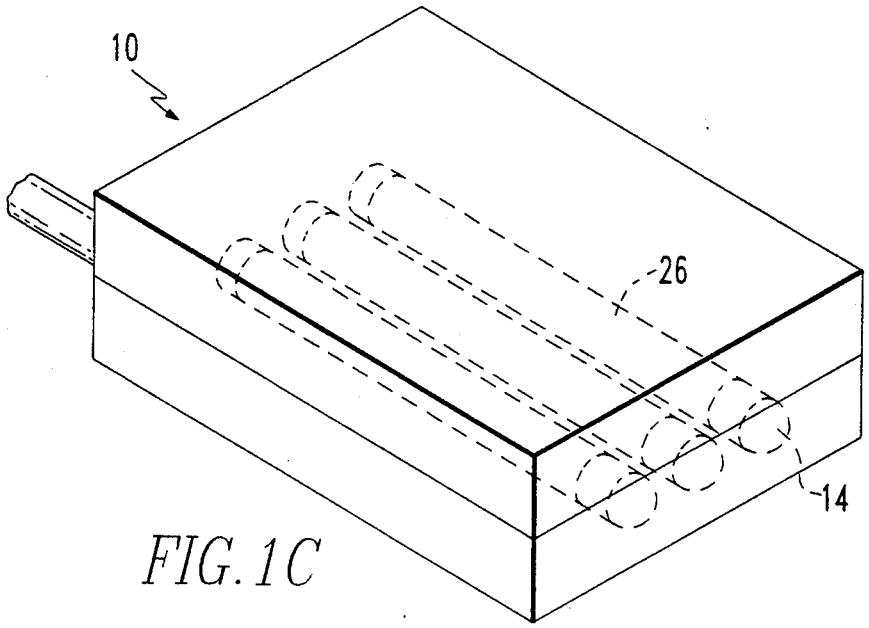

Referring now to the drawings wherein like reference numerals refer to similar or identical parts throughout the several views, and more specifically to FIG. 1 thereof, there is shown a perspective view which illustrates the casting of a metal matrix composite 10. The method comprises the steps of wrapping hollow cored inserts 14 with reinforcing material 16. The inserts 14 have closed ends 18 to prevent liquid metal 20 from entering their hollow cores 26. The inserts 14, with reinforcing material wrapped about, are then placed within a mold chamber 22 of a mold 24 in the proper orientation. Next, the mold 24 is infiltrated with liquid metal 20 so that the inserts 14 are encased and the reinforcing material is infiltrated. The liquid metal is then allowed to solidify and the metal matrix component 10 is removed from the mold 24.

Figure 2A:
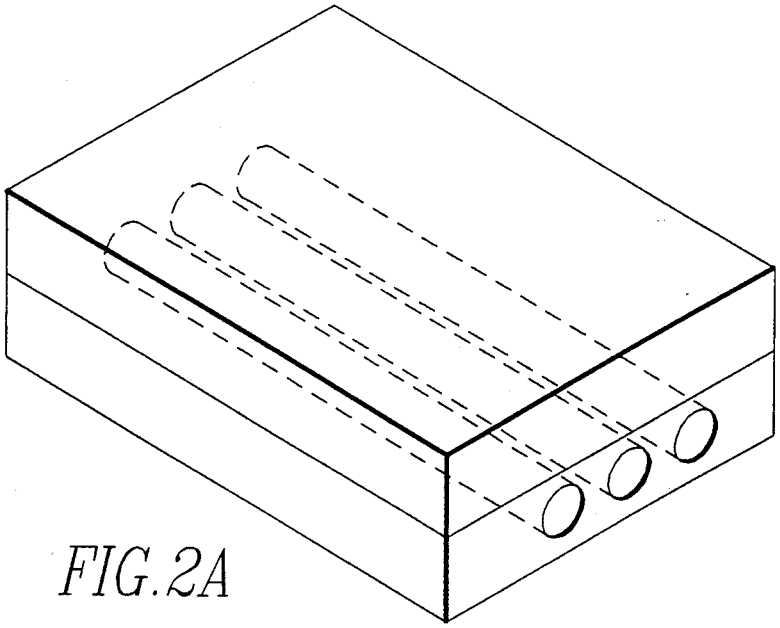
FIGS. 2A and 2B are perspective views showing the metal matrix composite with the closed ends removed followed by the leaching step to dissolve the material of the inserts.
Figure 2B:
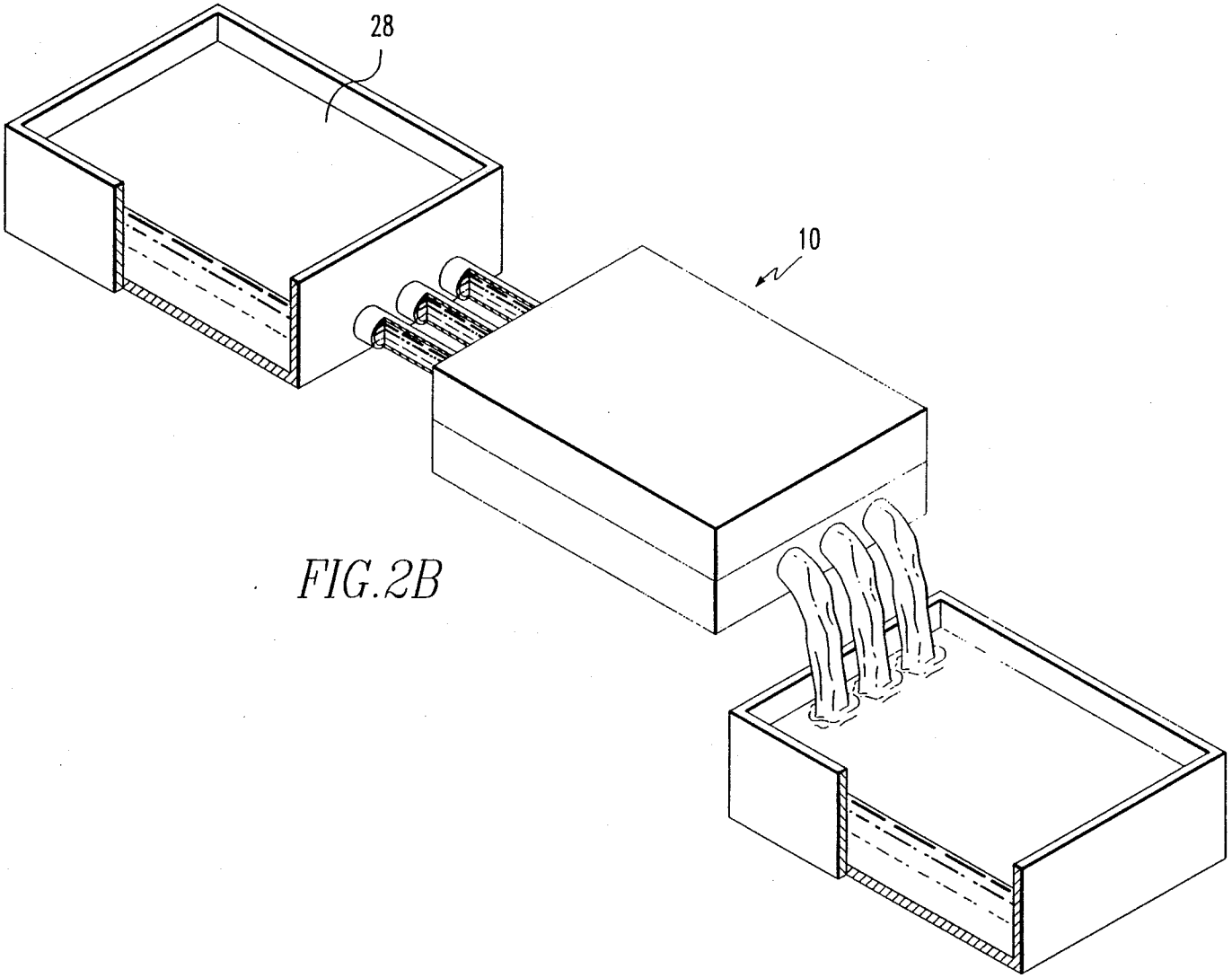

FIG. 2 shows the step of removing the closed ends 18 of the inserts 14 to expose the hollow cores 24 within. This can be done in a simple manner by grinding off the ends of the solidified metal matrix component 10 or by drilling directly into the hollow cores 26 of the inserts 14.

In many instances, it is preferable to remove the material of the inserts 14 from within the metal matrix component 10 after the metal 20 has solidified. A preferable method is to circulate a leaching solution 28 that will dissolve the material of the inserts 14, thereby leaving internal voids in the shape of inserts 14. In this manner, a metal matrix component 10 comprised purely of the liquid metal 20 and reinforcement material 16 is formed. A more detailed example of this method is described below.

Graphite fibers are wrapped on a 0.040" dia. hollow quartz tube with sealed ends. The wrapped tube is put into a mold and then the mold and fibers are heated and evacuated. Liquid metal is then forced into the mold to fill the mold and infiltrate the fibers around the tubes. For example P100 fibers around the tube can be infiltrated at 650° to 750° C. at 1000 to 1500 PSI with 6061 aluminum. After infiltration and solidification, the tube ends are exposed by cutting into them. Then, the tube can be leached out to leave a reinforced hole in the component. Hydrofluoric acid can be pumped through the tube to leach out quartz.

Figure 3:
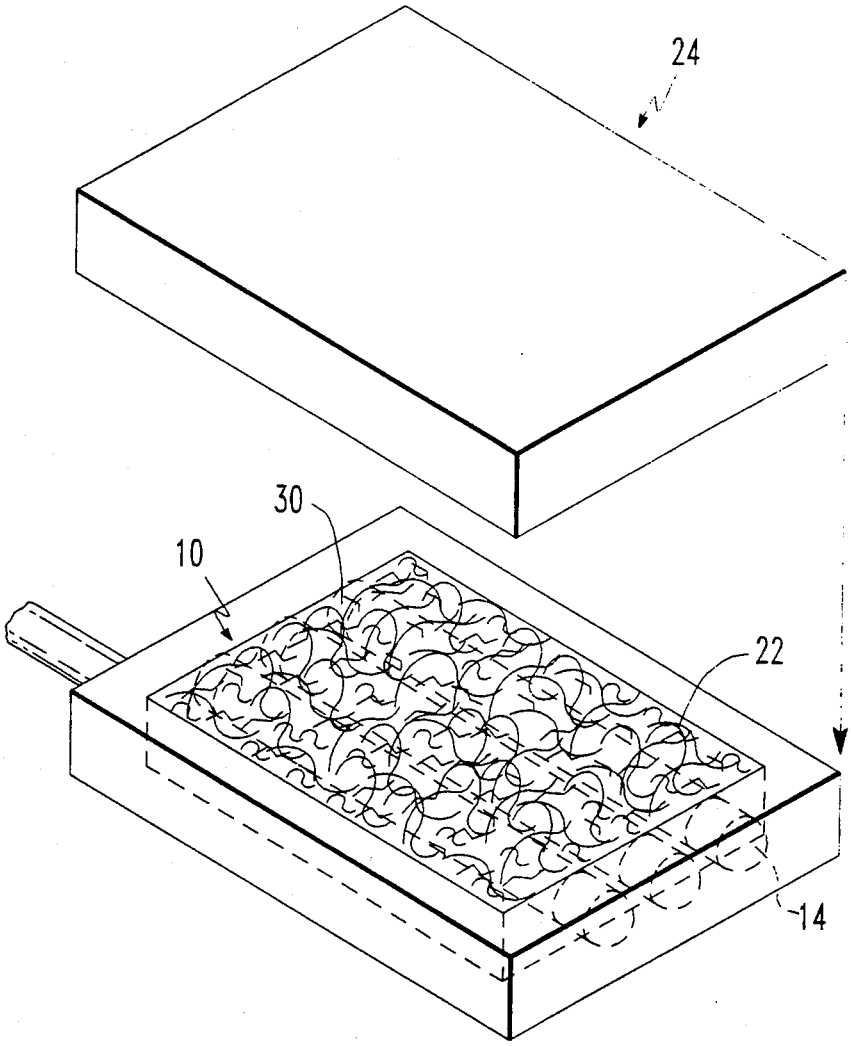
FIG. 3 is a perspective view showing several inserts encased with a preform of reinforcement material within a mold prior to the introduction of liquid metal.

FIG. 3 shows an alternative method of forming a metal matrix component 10. This method allows the entire metal matrix component 10 to be reinforced with reinforcing material 16. The method comprises the steps of first wrapping the hollow cored insert 14 with reinforcement material 16. Again, the inserts 14 have closed ends 18 to prevent liquid metal 20 from entering their hollow cores 26. Next, the inserts 14 are molded within a preform 30 of reinforcement material. Note that even when the inserts are encased in the preform 30, the reinforcement material 16 is normally wrapped around the inserts 14 to maintain the surface integrity and strength of the metal matrix component 10 in the area of the inserts 14. If desired, the inserts 14 can be molded directly into the preform 30 without wrapping.

After the inserts 14 are encased within a preform 30 of reinforcement material in a suitable manner, the inserts 14 in the preform 30 are placed within a mold chamber 22 of mold 24. It should be noted that the step of encasing the inserts or assembling inserts 14 within the preform 30 can take place within the mold or in a separate step outside the mold such that the preform holds the inserts in place. Next, the mold chamber 22 is infiltrated with liquid metal 20 so that the inserts 14 are encased and the interstices of the preform 30 are infiltrated. The liquid metal 20 is then allowed to solidify and the metal matrix component 10 with internal voids 12 is removed from the mold 24. If it is desired to form a pure layer of metal around the inserts, the inserts can first be encased in a suitable thickness of wax before being surrounded by the preform 30. After the inserts are surrounded by the preform, the wax can be melted out to leave a void layer in which the metal will fill.

In a preferred method of forming the preform, the encasing step includes the step of encasing the inserts within a preform mixture of liquid flow medium, binding agent and reinforcement material, such as SIC discontinuous fibers. Next, the preform mixture is heated at a controlled rate which evaporates the flow medium. Finally, the remaining reinforcement material and binder which is surrounding the inserts is sintered to form a solid porous preform 30. Note the previous steps can be performed within the mold chamber 22 prior to the introduction of liquid metal 20 or in a preferable manner outside the mold chamber 22. Reinforcement may also be formed in situ by a chemical reaction such as forming a carbon or sic foam around the inserts.

The methods described can also be used to bond various inserts into metal matrix composites. For example, hollow and solid metal inserts can be formed or contained in the preform and then infiltrated with liquid metal to bond them to the matrix metal and reinforcement. By controlling the surface reaction, it is possible to bond most materials together. Surface reaction can be controlled by surface treatment such as plating while oxidation can be prevented by casting in a vacuum. Inserts 14 can be used to form pure metal surfaces for mirrors with a composite backing structure to prevent warpage, electrical feedthroughs, or conductors, or insulators, or hollow metal cooling channels. Further, the inserts can be used as locations for secondary operation such as drilling or tapping. This removes the need for drilling into the reinforcement material. Inserts 14 comprised of quartz, salt, copper and stainless steel have been incorporated into metal matrix composites with the previously described methods.

Figure 4:
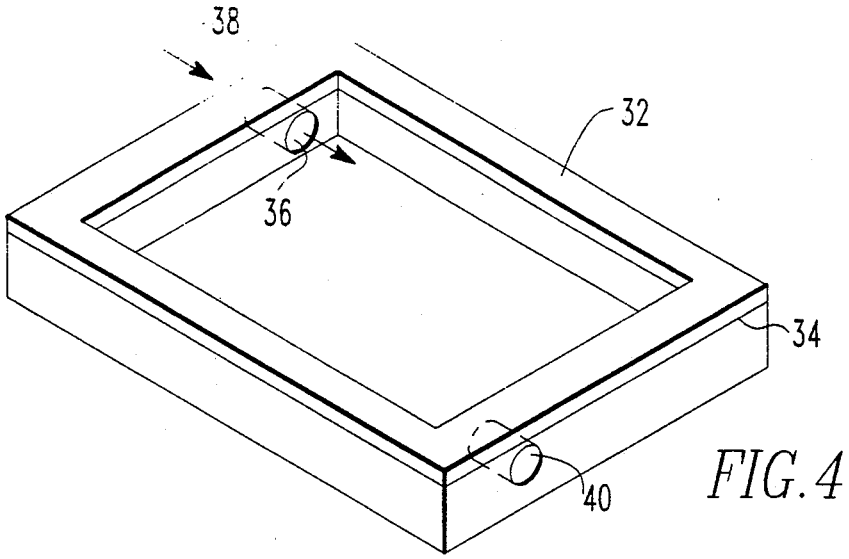
FIG. 4 is a perspective view of an electrical package having a variety of inserts.

FIG. 4 shows an electrical package 32 having a variety of useful inserts. Weld ring 34, disposed on top of the package 32, is used to weld the package 32 to other components. Feedthrough 36 is incorporated into the side of the package to support an electrically conductive wire 38. Metal insert 40 is used as a post molding drill location. These inserts are placed within the mold at the appropriate locations and held in place with reinforcement.

Figure 5:
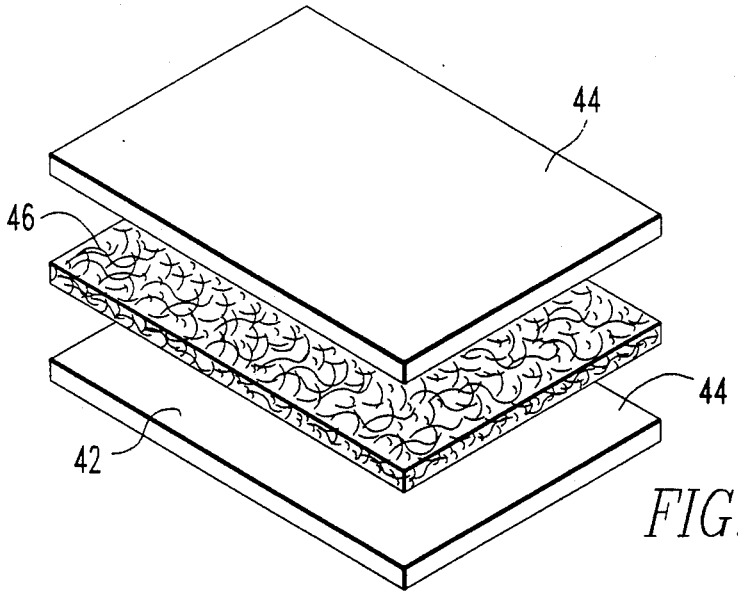
FIG. 5 is an exploded perspective view of a cooling panel.

FIG. 5 shows a cooling panel 42 which is comprised of two layers of metal sheets 44 which sandwich a layer of woven reinforcement fibers 46. The metal sheets are used to keep the reinforcement from contacting the interior of the mold 24. Preferably, the metal sheets 44 are comprised of copper and have a thickness of 0.003 inches. By varying the thickness and density of the fibers 46, preferably sic, the thermal properties of the panel 42 can be adjusted.

Figure 6:
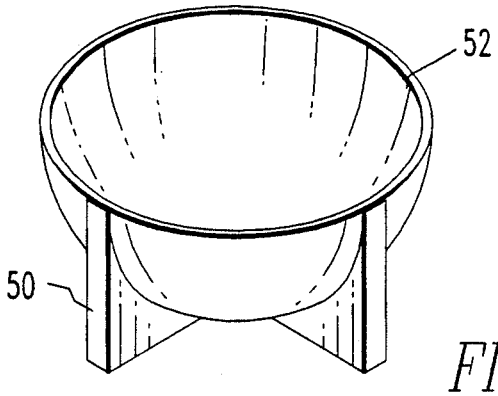
FIG. 6 is a perspective view of mounting for supporting a mirror.

FIG. 6 shows mounting 50 for supporting a mirror 52. Preferably, the mounting is comprised of sic discontinuous fibers which are infiltrated, during molding, with liquid metal. The mirror 52 is preferably a layer of nickel having a thickness of 0.01 inches. The composition, density and thickness of the fibers can be selectively altered to control the thermal properties of the mounting 50, thereby reducing the warpage in the mirror due to temperature changes.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method of forming a metal matrix composite comprising the steps of:

combining at least one insert with reinforcement material;

orienting the insert with reinforcement material within a mold chamber of a closed mold; and infiltrating the mold chamber with liquid metal such that the reinforcement material around the insert is infiltrated and the insert is completely encased within the metal.

2. A method as described in claim 1 wherein the combining step includes the step of wrapping the reinforcement around the insert.

3. A method as described in claim 1 wherein the insert comprises a hollow core with closed ends and including after the infiltrating step, the step of exposing the hollow core.

4. A method as described in claim 3 including after the exposing step, the step of removing the insert from the metal matrix composite.

5. A method as described in claim 4 wherein the removing step includes the step of leaching out the insert.

6. A method as described in claim 5 including after the wrapping step, the step of molding the insert within a mixture of reinforcement material, flow medium and binder.

7. A method as described in claim 6 including before the infiltrating step, the steps of:

removing the flow medium from the mold; and sintering the reinforcement material and binder to form a porous preform.

8. A method as described in claim 1 wherein the combining step includes the step of molding the insert within a preform mixture of reinforcement material, flow medium and binder.

9. A method as described in claim 8 including before the infiltrating step, the steps of:

removing the flow medium from the mold; and sintering the reinforcement material and binder to form a porous preform.

10. A method as described in claim 9 including before the combining step, the step of adding material to the surface of the insert.

11. A method as described in claim 10 wherein the adding step includes the step of coating the insert.

12. A method as described in claim 11 wherein the material is removable from the insert and including before the infiltrating step, the step of removing the material from the insert.

13. A method as described in claim 12 wherein the material is wax.

14. A method as described in claim 1 wherein the insert is comprised of metal.

15. A method as described in claim 1 wherein the insert is a metal surface for a mirror.

16. A method as described in claim 1 wherein the insert is comprised of ceramic.

17. A method as described in claim 1 wherein the insert is comprised of electrically insulated feed-through.

18. A method as described in claim 1 wherein the insert is a metal for welding.

19. A method as described in claim 1 wherein the insert is a metal sheet to prevent reinforcement away from reaching the interior of the mold.

20. A method as described in claim 1 wherein the reinforcement around the inserts is formed by the product of a chemical reaction.

21. A method as described in claim 20 wherein the chemical reaction produces a foam containing reinforcement material.

22. A method as described in claim 1 wherein the inserts are quartz.

23. A method as described in claim 1 wherein the inserts are salt.

24. A method as described in claim 1 wherein the inserts are copper.

25. A method as described in claim 1 wherein the inserts are stainless steel.

26. A method as described in claim 3 wherein after the exposing step, there is the step of circulating a fluid through said hollow core.

27. A method as described in claim 1 wherein the insert comprises a hollow core having sufficient volume to alter the insulative properties of the metal matrix composite a predetermined amount.

28. A method as described in claim 1 wherein the insert comprises a hollow core having sufficient volume to alter the weight of the metal matrix composite a predetermined amount.

29. A method as described in claim 1 wherein after the infiltrating step, there is the step of drilling into the insert.

30. A method of forming an electronic package comprising the steps of:

disposing a weld ring with reinforcement material within a mold chamber of a closed mold;

infiltrating the mold chamber with liquid metal such that the reinforcement material is infiltrated and the weld ring is completely encased within the metal.

31. A method of forming a component comprising the steps of:

disposing at least one cooling channel with reinforcement material within a mold chamber of a closed mold;

infiltrating the mold chamber with liquid metal such that the reinforcement material is infiltrated and the cooling channel is completely encased within the metal; and exposing the cooling channel such that a fluid can be circulated through the cooling channel.

* * * * *